United States Patent [19]

Huttle, Jr.

[11] 3,952,752

[45] Apr. 27, 1976

[54] SUSPENSION BRASSIERE

[76] Inventor: Frank Huttle, Jr., 530 Pratt St., Hammonton, N.J. 08037

[22] Filed: Aug. 7, 1974

[21] Appl. No.: 495,317

[52] U.S. Cl. ..... 128/486; 128/484

[51] Int. Cl.[2] ..... A41C 3/00

[58] Field of Search ..... 128/484, 486, 463, 494, 128/487, 485

[56] References Cited

UNITED STATES PATENTS

| | | | |
|---|---|---|---|
| 3,077,196 | 2/1963 | Paxton | 128/463 |
| 3,439,682 | 4/1969 | Defru | 128/484 X |
| 3,548,833 | 12/1970 | Lavergne | 128/484 |
| 3,709,230 | 1/1973 | Rich | 128/486 |

FOREIGN PATENTS OR APPLICATIONS

| | | | |
|---|---|---|---|
| 869,202 | 4/1971 | Canada | 128/486 |

*Primary Examiner*—H. Hampton Hunter
*Attorney, Agent, or Firm*—Morton C. Jacobs

[57] ABSTRACT

A suspension brassiere has an inner suspension section formed of flannel panels having perforations and connected directly to an anchor band that encircles the rib cage. The outer section is formed with cups whose outer seams coincide with the outer seams of the inner suspension panels.

4 Claims, 2 Drawing Figures

SUSPENSION BRASSIERE

BACKGROUND OF THE INVENTION

This invention relates to brassieres, and particularly to suspension brassieres.

Brassieres of the type of this invention, known as suspension brassieres, are described in U.S. Pat. Nos. 3,213,462, 3,033,206 and 3,164,155. In such brassieres, there is a breast supporting contour achieved by an inner panel section that is suspended and by an outer cup section that provides a shaping action. While such suspension brassieres have been effective, it is found that the two sections require special coordinated construction.

SUMMARY OF THE INVENTION

It is among the objects of this invention to provide a new and improved suspension brassiere.

Another object is to provide a new and improved suspension brassiere in which the inner panel structure is constructed to be firmly anchored to the user's body.

Another object is to provide a new and improved suspension brassiere in which the inner and outer sections are effectively coordinated.

In accordance with one form of the invention, a suspension brassiere is formed with an inner support section, and an outer cup section. The inner section includes two breast support panels that are joined at the inner edges thereof along a medial seam, and two side panels that are respectively joined at their inner edges to the outer edges of said breast support panels along panel seams. Separate stretch panels and brassiere attachments are joined to the outer edges of said side panels for completing the body encircling brassiere when used. A narrow, elongated elastic band extends along and is joined by seams directly to the lower edges of the support and side panels and of the stretch panels and attachment means so as to provide a yieldable body encircling anchor band for the support panels. A separate angular suspension strip has ends connected to the respective outer edge seam of the associated one of the support panels and to the medial seam. A separate shoulder strap is connected to the apex of each of said suspension strips. The outer cup section includes two separate fabric cups joined at the inner edges along a medial seam separated from the inner support section, and joined at the outer edges thereof to the support panels along the panel seams. Two fabric side panels are respectively joined at the inner edges to said fabric cups along said panel seams and at the outer edges to said stretch panel and attachment means. At the apex of each of said cups, means is provided for connecting to one of said shoulder straps. The anchor band is joined to the lower edges of said fabric cups and fabric side panels along the anchor band seams of the inner support section, whereby the inner support section and outer cup section are each directly secured along their lower edges to the body of the user and there retained during use.

BRIEF DESCRIPTION OF THE DRAWING

The foregoing and other objects of this invention, the various features thereof, as well as the invention itself, will be more fully understood from the following description when read together with the accompanying drawing, in which.

In the drawing, corresponding parts are referenced throughout by similar numerals.

Figure 2:
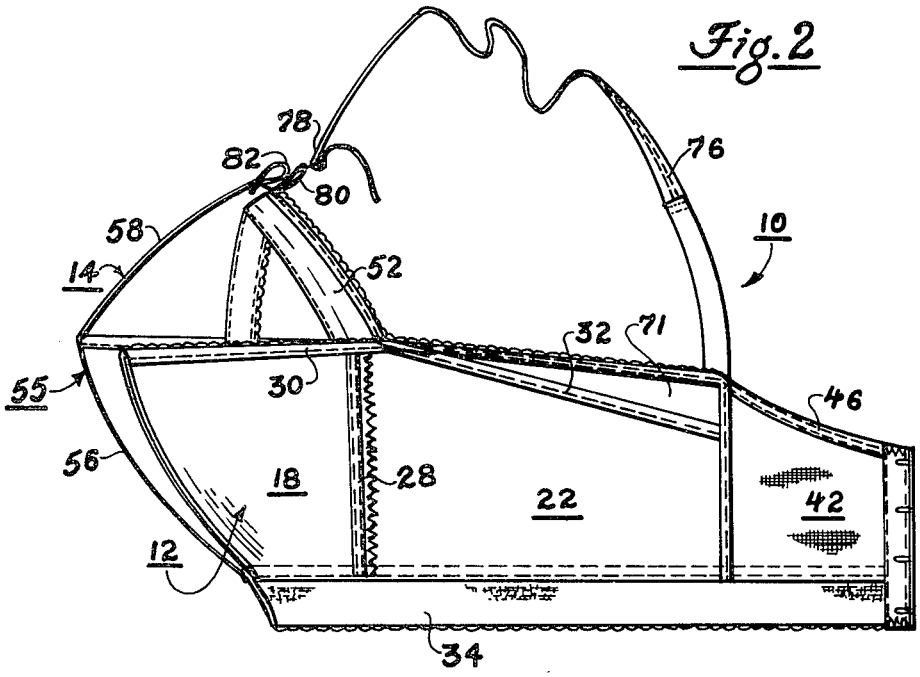
FIG. 2 is a side elevation view of the left side of the brassiere of FIG. 1 with parts cut away.
Figure 1:
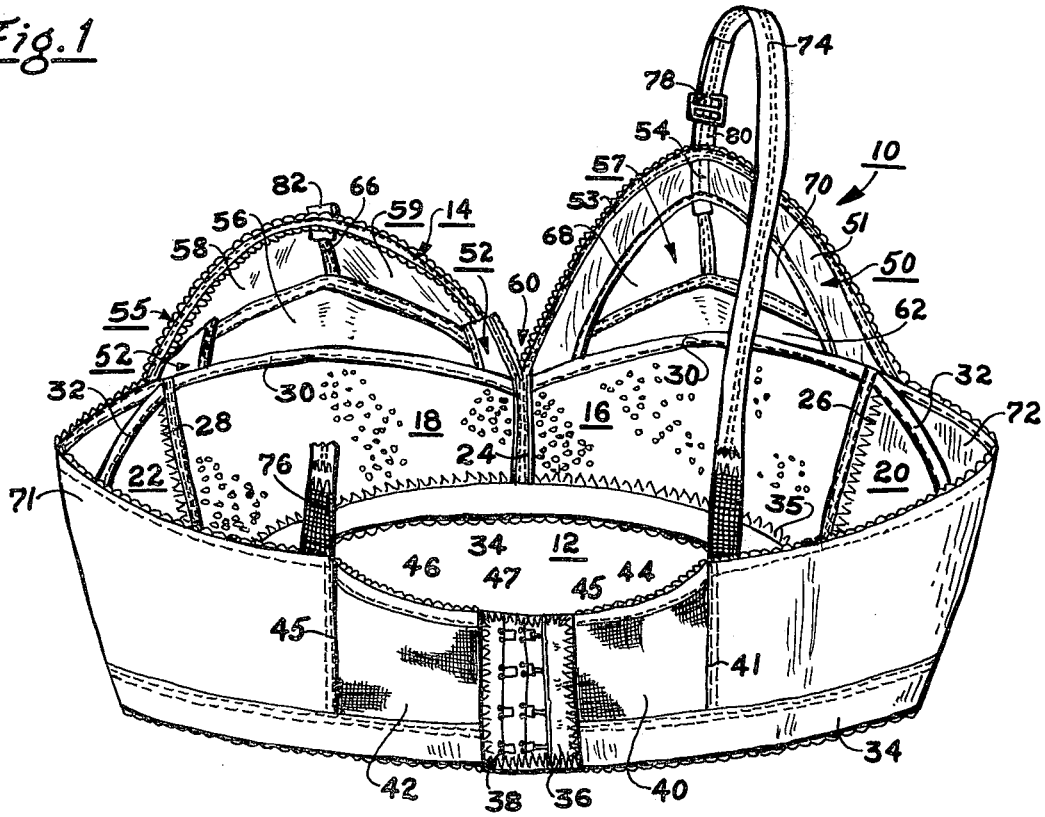
FIG. 1 is a perspective view of a brassiere embodying this invention in a position for use and as viewed from the rear, with parts cut away.

The brassiere 10 of this invention has an inner support section 12 and outer cup section 14. The support section is made up of four panels, 16, 18, 20 and 22 that extend most of the way around the brassiere. The inner edges of breast supporting panels 16 and 18 are sewn together along a medial seam 24 at the sternum or center line of the brassiere. At their outer edges, support panels 16 and 18 are respectively seamed to support panels 20 and 22 along panel seams 26 and 28, respectively. These support panels 16, 18, 20 and 22 are formed of flannel having a cotton backing for stiffening and numerous perforations therethrough (e.g. at ¼ inch spacing) for passage of air. Bindings 30 and 32 are sewn along the top edges of these flannel panels.

An anchor band 34 is joined via seam 35 along the bottom of the support panels 16, 18, 20 and 22. Anchor band 34 is formed of suitable material which is elastic along its length, and which may be 1-inch wide. This band is substantially inextensible along its width and also resists folding or buckling along the width. This elastic band 34 is one piece and extends completely around the lower edge of the brassiere between the two hook and eye attachment strips 36 and 38 which, in the conventional manner, are used to form the connection of the brassiere in actual use. A stretch panel 40 is connected between the side panel 20 and attachment strip 36 along seams 41 and 43, and a stretch panel 42 is connected between side panel 22 and attachment strip 38 along seams 45 and 47. The panels 40 and 42 are also seamed along their bottom edges to anchor band 34, and they are formed of a material that is elastic around the circumference in the same direction as elastic anchor band 34. Along the inclined upper edges of stretch panels 40 and 42, bands 44 and 46 are attached which are elastic along the bands' length, whereby a certain individuality of movement is added to that offered by the elastic panels 40 and 42.

A separate triangular suspension strip 50 or 52 is provided for each of the breast supporting bands 16 or 18. Each of the suspension strips 50 or 52 is formed in two pieces 51 and 53, which are connected by a seam 54 along a line generally corresponding to the high contour of the upper portion of the supported breast. Outer strip 51 is anchored along an edge to the panel seam 26 along its entire length between the panels 16 and 20 and at its lower end via seam 35 to the anchor band 34. Inner strip 53 is anchored to seam 27 along its entire length between the supporting bands 16 and 18 and also at its lower end to the anchor band seam 35. The attachment of the pieces of suspension strip 52 is constructed in a symmetrical fashion similar to that described for the pieces of suspension strip 50; the strip 52 has been cut away for simplicity of illustration, and only the anchored portions thereof are shown adjacent to the support band 18. The inner strip of the triangle suspension 52 is seamed to the inner strip 53 of suspension 50 along seam 24, which extends above panels 16 and 18.

The outer cup section 14 is formed with two brassiere cups 55 and 57, each of which is a three-panel section of lace or other light-weight ornamental fabric made of nylon or the like. That is, the lower section of the left cup 55 is formed as a single panel 56 sewn at its bottom edge to band 34 and extending from seam 28 to a central seam 60 along the sternum line, to which is joined the corresponding lower panel 62 of right cup 55. The central seam 60 is free of seam 24 and of the inner support section 12.

The upper section of the left cup 55 is formed of two panels 58 and 59, joined at their lower edges to panel 56, and which are joined along the high countour seam 66, with the outer panel 58 attached to seam 28, and the inner panel 59 attached to the central seam 60, where it is joined to the inner panel 68 of the upper section of the right cup. The two cups 55 and 57 are formed symmetrically, so that the two panels 68 and 70 of the upper section of the right cup 57 are formed in a fashion similar to that of the left cup 55. Cup section 14 of the brassiere comprise the two panels 71 and 72 which are respectively connected between seams 28 and 45 and seams 26 and 41.

The construction of the suspension section 12 of the brassiere with the four panels 16, 18, 20 and 22, ensures a weight distribution that is uniform and equally applied around the entire inner band support from seam 41 through the panels 16, 18, 20 and 22 to seam 45. The suspension strips 50 and 52 are connected at their apices to the shoulder straps 74 and 76 via conventional adjustment buckles 78, the other ends of which straps are sewn to the lace panels 70 and 72 at reinforced seams 45 and 41, respectively, which ensure a sturdy connection to side panels 22 and 20. In addition, due to the inclined elastic strips 46, the straps 74 and 76 have yieldable connection to the back of the brassiere that yields with bending. Thereby, the full suspension action is achieved. The buckles 78 have a permanent connection to a loop 80 at the apex of each suspension strip 50 and 52, and a detachable connection to a loop 82 at the apex of each outer cup 54 and 55.

The outer cup section 14 produces some weight support and distribution of weight around the brassiere. However, the inner support section 12 performs the principal function of weight support and distribution. The lace cups 54 and 55 of the outer section 14 provide a smooth contour line over the bust and also provide a lateral support for the side panels. The seams 26 and 28 locate the cups 54 and 55 and fix them to support panels 18 and 16. The fabric of the lace side panels 70 and 72 is so designed that the upper edges of the lace do not cut into the underarm of the user. The anchor band 34 does not cut or bind around the midriff of the user and provides secure and well-contoured support for the inner support section of the brassiere as well as the outer cup and lace.

In use, this brassiere can be individually fitted to the user. Initially the fitting is performed via the inner suspension section and completed with the outer cup section.

Thus, the brassiere is built on the supporting foundation of a pair of suspension bands 16 and 18 formed of cotton flannel backed with a suitable cotton fabric which are anchored to an elastic band 34 extending around the rib cage to the hook and eye attachment in the back of the brassiere. The flannel bands have breathing holes in them throughout their surface, which holes increase the friction and assure the maintenance of the suspension during use and movement. The suspension bands 16 and 18 extend all the way down to the encircling elastic band 34 which is also transversely firm in the connection to the bands. In addition, the flannel bands extend via the side panel to the hook and eye attachment of the back by way of a one-way stretch panel. The contour forming cups 55 and 57 are also connected to the anchor band 34 and to the panel seams 26 and 28.

Various modifications will be apparent to those skilled in the art. For example, a variety of materials may be used, and ornamental fabrics and design may be employed without interfering with the structural features of the invention. These and other modifications and changes in the details of construction may be made within the spirit and scope of this invention as set forth in the following claims.

Thus, a new and improved suspension brassiere is provided by this invention in which the inner suspension panel is firmly anchored to the user's body, and in which the inner and outer sections are effectively coordinated.

What is claimed is:

1. A suspension brassiere comprising an inner support section, and an outer cup section;

said inner section including two breast support panels joined at the inner edges thereof along a medial seam, two side panels respectively joined at the inner edges thereof to the outer edges of said breast support panels along panel seams;

separate stretch and brassiere attachment means joined to the outer edges of said side panels for completing the body encircling brassiere when used;

a narrow, elongated elastic band extending along and joined by seams directly to the lower edges of said support and side panels and of said stretch and attachment means, said elastic band being extensible along the length thereof and substantially inextensible and resistant to folding along the width thereof so as to provide a yieldable body-encircling anchor band for said support panels;

a separate angular suspension strip having ends connected to the respective outer edge seam of the associated one of said support panels and to said medial seam;

and a separate shoulder strap connected to the apex of each of said suspension strips;

said outer cup section icluding two separate fabric cups joined at the inner edges thereof along a medial seam separated from said inner support section, and at the outer edges thereof to said support panels along the associated panel seams, two fabric side panels respectively joined at the inner edges to said fabric cups along said panel seams and at the outer edges to said stretch and attachment means;

and means at the apex of each of said cups for connecting to one of said shoulder straps;

said anchor band being joined to the lower edges of said fabric cups and fabric side panels along said anchor band seams of said inner support section;

whereby said inner support section and outer cup section are each directly secured along the lower edges thereof to the body of the user and there retained during use.

2. A suspension brassiere as recited in claim 1 wherein said breast support and side panels are formed of body engaging flannel with fabric backing and numerous perforations therethrough.

3. A suspension brassiere as recited in claim 2 wherein said suspension strips are connected along the length of said medial and outer edge seams and at the bottom edge thereof to said anchor band.

4. A suspension brassiere as recited in claim 3 wherein each of said cups is formed of three joined fabric panels.

* * * * *